United States Patent [19]

Azzerri et al.

[11] 4,236,977

[45] Dec. 2, 1980

[54] METHOD FOR PREPLATING STEEL SURFACES

[75] Inventors: Nazzareno Azzerri, Pomezia; Giovanni Milanese, Genoa, both of Italy

[73] Assignee: Italsider, S.p.A., Genoa, Italy

[21] Appl. No.: 936,931

[22] Filed: Aug. 25, 1978

Related U.S. Application Data

[63] Continuation-in-part of Ser. No. 806,508, Jun. 14, 1977, abandoned.

[30] Foreign Application Priority Data

Jun. 24, 1976 [IT] Italy ..... 50110 A/76

[51] Int. Cl.[3] ..... C25D 5/36

[52] U.S. Cl. ..... 204/29; 204/34; 204/40

[58] Field of Search ..... 204/29, 34, 40, 54 R, 204/54 L

[56] References Cited

U.S. PATENT DOCUMENTS

| | | | |
|---|---|---|---|
| 2,673,836 | 3/1954 | Vonada | 204/34 |
| 3,285,838 | 11/1966 | Morgan | 204/37 |
| 3,620,934 | 11/1971 | Endle | 204/34 |
| 3,787,297 | 1/1974 | Beckwith | 204/55 R |
| 4,127,450 | 11/1978 | Azzerri | 204/29 |

OTHER PUBLICATIONS

Electroplating Engineering Handbook-A. Kenneth Graham, Editor, Reinhold Publishing Co., 1962, p. 647.

*Primary Examiner*—John H. Mack
*Assistant Examiner*—William Leader
*Attorney, Agent, or Firm*—Robert E. Burns; Emmanuel J. Lobato; Bruce L. Adams

[57] ABSTRACT

A method according to the invention is based on the combination of the activation treatment of a steel object in an aqueous neutral solution with the use of auxiliary electrodes, dipped in the same activating solution, which causes the steel to be pre-plated.

3 Claims, 1 Drawing Figure

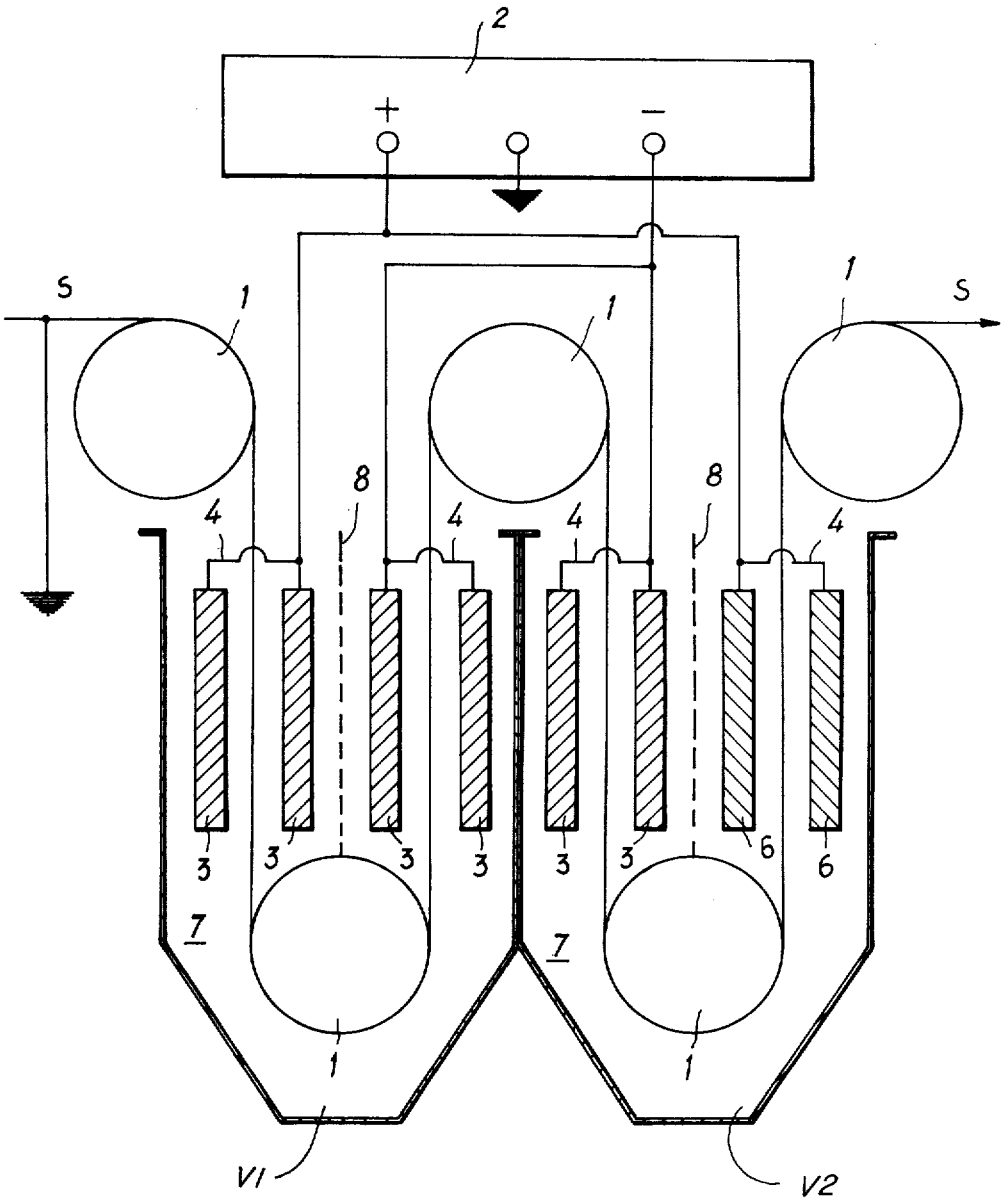
2
+
−
S
1
1
1
S
8
8
4
4
4
4
3
3
3
3
3
3
6
6
7
7
1
1
V1
V2

METHOD FOR PREPLATING STEEL SURFACES

This is a continuation-in-part of our application, Ser. No. 806,508 filed June 14, 1977 now abandoned.

BACKGROUND OF THE INVENTION

As it is known, in the case of tin-plate the pre-plating technology has up to now developed along two lines. One line brought to the pre-plating method the use of a bath of an acid nature wherein the plating material is present in the cationic form (e.g. $Sn^{+2}$, stannous ion).

The second line led to the use of an alkaline solution wherein the pre-plating metal is present in the anionic form (e.g. $SnO_3^{-2}$, stannate ion).

As it is known, to get a good plating it is necessary that the surface of the material to be plated is completely clean.

The prior art, as far as steel platings are concerned, requires that the article to be plated is previously subjected to suitable pre-treatment operations, i.e. subjected to operations such as surface preparation, cleaning and acid pickling.

However, this pre-treatment technology has several inconveniences in its practical use. Among these inconveniences there are the chemical agressiveness of the detergent and deoxidizing agents causing the decrease of plant life, and the problem of all the matters concerning maintenance, work hygiene and work safety.

Further, the discharge of the exhaust waters from the treatments contributes remarkably to the environmental pollution and the alteration of the local ecological and geochemical equilibria.

Finally, the depuration processes of the exhausted baths are considerably complicated from both the technical and economical point of view.

The above inconveniences are partially overcome by using as the pre-treatment a neutral electrolyte of sodium sulphate as described in U.S. patent application Ser. No. 726,788 now U.S. Pat. No. 4,127,450. Such a treatment consists essentially in the steel to be plated being made alternatively cathode and anode in an electrolysis cell. From the electrochemical point of view, said pre-treatment may be included in the following reaction scheme:

anode (positive pole) $2OH^- \rightleftarrows H_2O + \frac{1}{2}O_2 + 2e$ cathode (negative pole) $2H^+ \overset{ne}{\rightleftarrows} H_2$ global reaction $2OH^- + 2H^+ \rightleftarrows H_2O + \frac{1}{2}O_2 + H_2$ The reaction scheme shown clearly means that the cations and anions of the sodium sulphate and the other salts possibly present, do not participate in the redox semi-reactions cathodic and anodic respectively.

During the surface treatment in a neutral solution according to the above pre-treatment, there is consequently no consumption of solute, but only of $OH^-$ and $H^+$ ions coming from the ionic dissociation of the water (whose amount therefore needs to be kept constant). Obviously, the activating action of the pre-treatment with respect to the surface depends on secondary reactions its components participate in.

OBJECT OF THE INVENTION

The present invention relates to improvements in the method for raising the susceptibility of steel to platings as described in U.S. patent application Ser. No. 726,788 now U.S. Pat. No. 4,127,450. Particularly the invention has for its object to provide a method for further raising the susceptibility of steel surfaces to metal platings by pre-plating the surfaces in the final stage of activation before the final main plating.

SUMMARY OF THE INVENTION

According to the present invention, a steel object made alternatively cathode and anode in an electrolitic cell, is subjected to the effects of a neutral pH activating solution, at temperatures selected in the range 20° to 100° C., at current densities between 1 and 60 A/dm$^2$, for treatment times from 0.1 second to 1 minute.

Further according to the invention, in a final stage of activation, soluble auxiliary anode electrodes are inserted. Such electrodes work with anodic polarity and consist of the final plating material or of another material suitable for the pre-plating.

The mentioned final main plating refers to an additional, completely separate plating step performed after the pre-plating step of the invention.

In the pre-plating step the steel is subjected to the same operating conditions as the activating step in terms of pH and temperature ranges of the solution and in terms of treatment time and current density ranges. The composition of the solution however includes also a negligible amount of metal ions to be used for pre-plating which do not affect adversely the activation stage. The negligible solution derives from the very low solubility of the respective salts in such a medium. For these reasons the attempts to bring in industrial use the process hereinbefore referred to as "first line along which the pre-plating technology has so far developed" have failed in the past. According to the present invention, the provisions . . . "

The auxiliary anode electrodes in the last activating stage causes in the bath electrochemical reactions which may be shown as follows (where 'M' is the pre-plating active metal: 'a.e.' is an auxiliary electrode; 'A' is the steel to be pre-plated):

| | |
|---|---|
| $M\ (a.e.) \rightarrow M^{n+} + ne$ | (anode (+) |
| $M^{n+} + ne \rightarrow M\ (A)$ | cathode (−) |
| $M\ (a.e.) \rightarrow M\ (A)$ | global reaction |

In such a way, it is not necessary that the solution initially contain the ions to be pre-plated, as they are provided by the dissolution of said auxiliary electrode.

Owing to the negligible solubility of the M salts, the proper steady-state concentration of $M^{+n}$ is quickly reached into neutral solution by dissolution of the soluble anodes which occurs within a negligible time without any practical prejudice for the effectiveness of the pre-plating treatment. The steady-state concentration is maintained due to anode dissolution efficiency greater than the cathodic plating efficiency.

As pre-plating active metals are suitable all the metals meeting the double requirement of being soluble anodically during the electrolytic neutral treatment and being susceptible of discharging cathodically on the metal to be pre-plated. Finally, it is to be appreciated that the pre-plating metals may or may not be the same as those necessary in the plating treatment. For example, in the case of electrotinning good results in pre-plating are obtained with zinc, copper, nickel, iron, manganese and alloys thereof.

The method of pre-plating according to the invention can be applied in a continuous pre-plating process as well as for a batch pre-plating.

BRIEF DESCRIPTION OF THE DRAWING

The sole drawing is a longitudinal elevation view in section of a plant or cell arrangement for carrying out the invention.

DESCRIPTION OF A PREFERRED EMBODIMENT

In the drawing is shown schematically a longitudinal section of a plant where the pre-treatment in a neutral solution and the pre-plating according to the invention take place. In such a plant the strip S to be treated is subjected to continuous operation.

The plant consists of two vessels, each containing the same neutral electrolytic solution 7. In the first vessel (V1) the activating pre-treatment, described in U.S. patent application Ser. No. 726,788, takes place. In the second vessel (V2) the pre-plating according to the invention is performed.

The strip S passes by means of the guide roll 1 in the space between the pairs of insoluble electrodes 3 where it undergoes the activating pre-treatment. The strip is then guided by other rolls in the space between the soluble auxiliary electrodes 6 where the pre-plating occurs.

During the whole treatment (pre-treatment and pre-plating) the strip (which is ground connected) assumes always a polarity opposite with respect to the adjacent electrode pairs. Particularly, the steel strip or sheet when passed through the electrodes 6 behaves as a cathode thus permitting the metal coming from the anodic dissolution of electrodes 6 to be deposited thereon. At the end of the above operations the strip is further processed in other vessels, not shown, in order to be coated with the final galvanic coating.

In the drawing the references not mentioned in the above description have the following meaning:

2: D.C. power supply;

4: electrical connections between electrode pairs;

8: insulating shields (to avoid current leakage).

EXAMPLE OR A PREFERRED EMBODIMENT

A steel sheet with a thickness of 0.2 mm (black plate) is subjected to the surface treatment according to the invention, before being treated the electrotinning line.

The following sequence of polarity: cathodic for 1 second, anodic for 2 seconds, cathodic for 1 second is applied to the steel immersed in an acqueous solution 1.5 M in $Na_2SO_4$ at a temperature of 40°±5° C. The current density flowing through the system is 20 A/dm$^2$.

The electrodes in the last step of treatment consist of bars of pure tin. The electric and electrolytic conditions are the same as used in the preceding steps of neutral electrolytic pre-treatment. A uniform tin pre-plating with a thickness of about 0.01$\mu$ is so obtained on the steel sheet.

The nature of the deposit according to the invention consists of thin "islands" of tin localized on the surface points more activated in the previous treatment. The coverage degree depends on treatment time and, provided that the pre-plating is long enough, could be 100%. Taking into account the foregoing, "mean thickness" is the best way to define the feature of the preplating.

Afterwards, the steel sheet is electrotinned in a bath containing the Ferrostan (registered trademark) electrolyte at a temperature of 45° C. with a current density of 20 A/dm$^2$. The speed of the strip moving along the line is 200/m/min.

The product obtained, plated with 22.4 g of tin per square meter, is then brightened through melting and subsequent cooling in water.

The quality of the product obtained was evaluated on the basis of ATC (Alloy-Tin-Couple) measurements, recognized by ASTM (Standard Specification A623-A6).

The treatment according to the invention provides a product with an ATC value lower than or equal to 0.15 $\mu$A/cm$^2$.

The good value obtained is explained by the fact that the intermediate layer of iron-tin alloy is very compact. This result is due to the fact that the pre-plating during the activating treatment avoids the inconveniences deriving from the partial atmospheric reoxidation of the activated steel.

It is to be understood that the invention is not limited to the examples shown. It is intended to cover all modifications and equivalents within the scope of the appended claims.

What we claim is:

1. A method for raising the susceptibility to plating of steel articles by pre-plating comprising, passing a steel object through an electrolytic cell containing in a first part thereof an aqueous neutral solution in which the steel object is an anode passing the steel object through a second part of said cell containing said solution solution in which said steel object has current of cathodic polarity applied thereto so that it functions as a cathode, said second part of the cell having soluble anode electrodes made of a metal chosen from the group consisting of tin, zinc, copper, nickel manganese and iron, applying said current at a density effective to preplate said steel object with cations supplied by said soluble anode electrodes, said solution having a concentration of essentially 0.5 to 2.4 M in sodium sulfate with a pH between 6 and 8, said current density being between 15 and 60 Amps./dm.$^2$, and the temperature of the solution ranging between 30° to 60° C.

2. A method according to claim 1, in which said steel object is a steel sheet.

3. A method according to claim 1, in which said anode electrodes are made of an alloy of one of the metals chosen from the group consisting of zinc, copper, nickel, manganese and iron when said steel object is to be tinned.

* * * * *